United States Patent [19]

Silverman

[11] 4,027,442

[45] June 7, 1977

[54] METHOD OF CONSTRUCTING SWIMMING POOLS

[75] Inventor: Herman Silverman, Doylestown, Pa.

[73] Assignee: KDI Sylvan Pools, Inc., Doylestown, Pa.

[22] Filed: Feb. 18, 1976

[21] Appl. No.: 659,032

Related U.S. Application Data

[63] Continuation-in-part of Ser. No. 511,533, Oct. 3, 1974, abandoned.

[52] U.S. Cl. ..... 52/309.4; 52/309.13; 52/742; 52/169.7; 4/172; 428/321; 428/489

[51] Int. Cl.² ..... E04H 3/16; E04G 23/00

[58] Field of Search ..... 52/742, 169, 309; 4/172; 264/45.1; 249/DIG. 3; 127/292, 236; 428/489, 321

[56] References Cited

UNITED STATES PATENTS

| | | | |
|---|---|---|---|
| 3,429,085 | 2/1969 | Stillman | 52/169 |
| 3,468,771 | 9/1969 | Pedlow | 52/309 |
| 3,563,845 | 2/1971 | Stevens | 52/309 |
| 3,698,927 | 10/1972 | Sawyer | 428/321 X |
| 3,840,908 | 10/1974 | Greene | 52/169 |
| 3,841,041 | 10/1974 | Friedland et al. | 52/169 |
| 3,893,275 | 7/1975 | Omholt | 52/309 |

*Primary Examiner*—J. Karl Belu

*Attorney, Agent, or Firm*—Zachary T. Wobensmith, 2nd; Zachary T. Wobensmith, III

[57] ABSTRACT

A method of constructing swimming pools is described which includes spraying a mass of foamable plastic against the exposed pool wall surface of an assembled pool which plastic material adheres thereto and hardens, forming a dense resilient foam mass with a hardened exterior skin facing toward the interior of the pool, and applying an ultraviolet protective covering to the skin to improve its resistance to light and moisture.

5 Claims, 5 Drawing Figures

FIG. 1
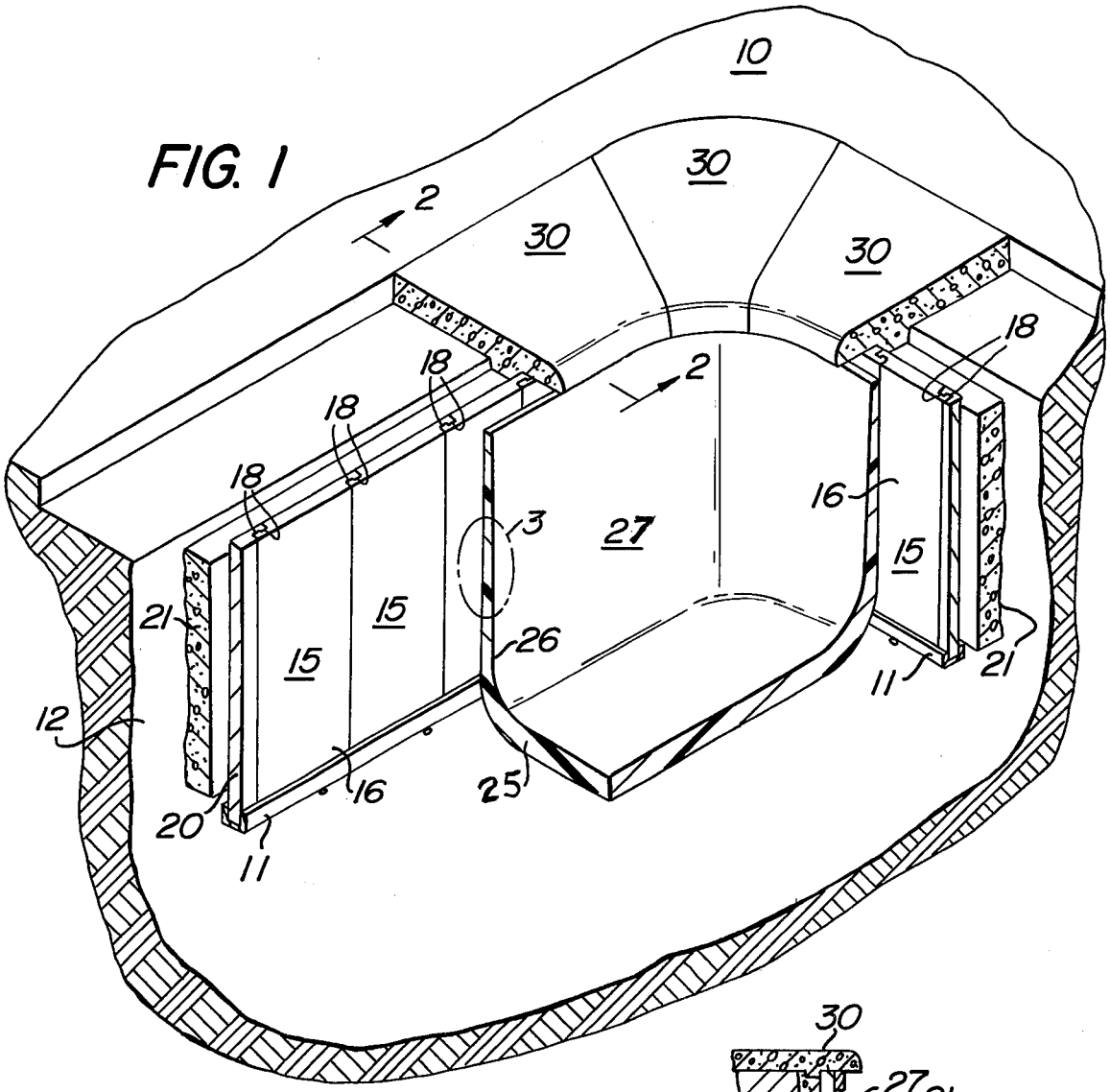
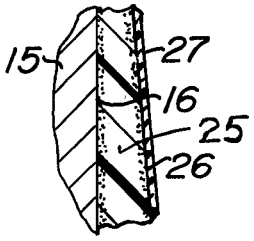
FIG. 3
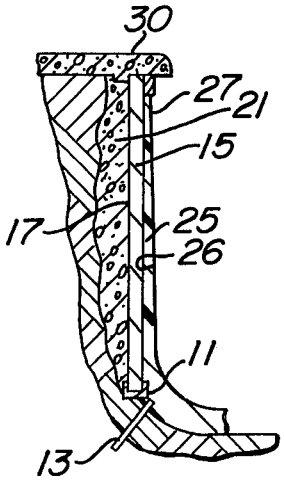
FIG. 2

METHOD OF CONSTRUCTING SWIMMING POOLS

CROSS REFERENCE TO RELATED APPLICATION

This application is a continuation in part of my prior application Ser. No. 511,533, filed Oct. 3, 1974 now abandoned.

BACKGROUND OF THE INVENTION

1. Field of the Invention

This invention relates to a method of constructing swimming pools wherein the pool wall surface of a previously assembled swimming pool is covered with a layer of foamable plastic material.

2. Description of the Prior Art

The utilization of polyurethane foam to form a swimming pool using the earth as a form is not new. The U.S. Pat. No. 3,429,085, to Stillman, shows a swimming pool in which the bottom and sides of the excavated ground provide a form for the application of a plurality of layers of foam in a first less dense foam and then in a second more dense layer with an interior cover liner such as a vinyl liner placed thereon.

No method of constructing a swimming pool utilizing previously assembled pool walls to which foam is applied is even contemplated in Stillman.

The U.S. Pat. No. 2,903,380, to Hoppe describes a process for producing composite structure comprising rigid polyurethane foams and covering layers. The patent describes the process of covering the material to which the foam is to be applied with a preliminary covering of a polyesterisocyanate mixture to which the foam bonds. No swimming pool is shown or suggested in Hoppe.

The U.S. Pat. No. 3,698,927 to Sawyer describes a foam structure with a protective overcoat. In this patent the material can be formed in place as a roofing cover wherein the building acts as a form for the foam structure.

No swimming pool is shown or suggested in the Sawyer patent.

The U.S. Pat. No. 3,841,041 to Friedland et al. describes a swimming pool formed in the ground of a rigid, plastic material such as polyurethane foam, the modulus of elasticity of the side walls being close in value to the surrounding soil to provide uniform stress distribution and avoidance of crack formation. A fluid tight lining is applied to the foam and a few pins may be anchored in the foam and the ground. No swimming pool wherein the structure to which the foam is to be applied is a previously assembled pool is contemplated in Friedland et al.

Many of the prior art patents disclose structures wherein the ground provides a form for the pool to be built and in which the foam is directly engaged therewith determining the slope of the pool but none discloses the foam application to a previously assembled pool.

It is desirable to provide swimming pools of low cost with high integrity against water leakage and with side walls that are not likely to deform. The use of swimming pools with a lower channel into which interlocking aluminum boards are placed with an upper channel carrying a removable vinyl liner has become increasingly popular. The vinyl liners used with such pools are restricted in shape and do not have as long a service life as is desired. Such vinyl liners are difficult to remove for repair or replacement and the fact that they must be capable of removal restricts the type of coping that can be utilized thereon.

Another type of pool in use is constructed of heavy gauge aluminum plates welded together along each intersecting edge to form continuous walls. It is very difficult to weld aluminum, the heat involved and the size of the plates being such that it is almost impossible to prevent warpage and obtain a satisfactory finished surface, and such welds are often subject to leakage due to inclusion of air pockets. The welds must be ground and the surface of the plates treated with acid prior to painting which is a difficult and dangerous process. In climates where the ground temperature is lower than the pool water temperature, the high thermal conductivity of aluminum results in a lowering of pool water temperature. In climates where the surrounding ground temperature is high then the water in the pool may reach an unacceptable level. The result is that optimum water temperature in all aluminum pools is difficult and expensive to maintain.

No satisfactory paint has been developed which will bond well to and provide any degree of permanence when used on aluminum pools.

My invention provides an economical method of constructing swimming pools of aluminum boards or sheets which in addition to providing a finished surface for painting improves the safety and appearance of the pool while aiding in maintaining the water at a more even temperature.

SUMMARY OF THE INVENTION

In accordance with the invention an improved method of constructing swimming pools is provided, wherein an assembled static structure preferably of aluminum sheets or boards is employed, plastic material is sprayed against the exposed surface of previously assembled pool walls which plastic material adheres thereto, foams and becomes a hardened resilient foam mass with a hardened exterior skin, which skin is treated with an ultraviolet light and moisture resistant coating, thereby providing a finished swimming pool.

The principal object of my invention is to provide an improved method of constructing a swimming pool as aforesaid.

A further object of my invention is to provide an improved method of constructing a swimming pool which provides an attractive finished surface.

A further object of my invention is to provide an improved method of constructing a swimming pool which increases the degree of bather safety.

A further object of my invention is to provide an improved method of constructing a swimming pool which provides a pool having great rigidity and superior water retention properties.

A further object of my invention is to provide an improved method of constructing a swimming pool which pool maintains the water therein at a more even temperature than has been previously attained with pools of such type.

Other objects and advantageous features of the invention will be apparent from the description and claims.

DESCRIPTION OF THE DRAWINGS

The nature and characteristic features of the invention will be more readily understood from the following description taken in connection with the accompanying drawings forming part hereof, in which:

FIG. 1 is a fragmentary perspective view of one form of swimming pool constructed in accordance with the method of my invention;

FIG. 2 is a fragmentary vertical sectional view, enlarged, taken approximately on the line 2—2 of FIG. 1;

FIG. 3 is a fragmentary view, enlarged, of the swimming pool of FIG. 1 taken at the location 3 of FIG. 1;

Figure 4:
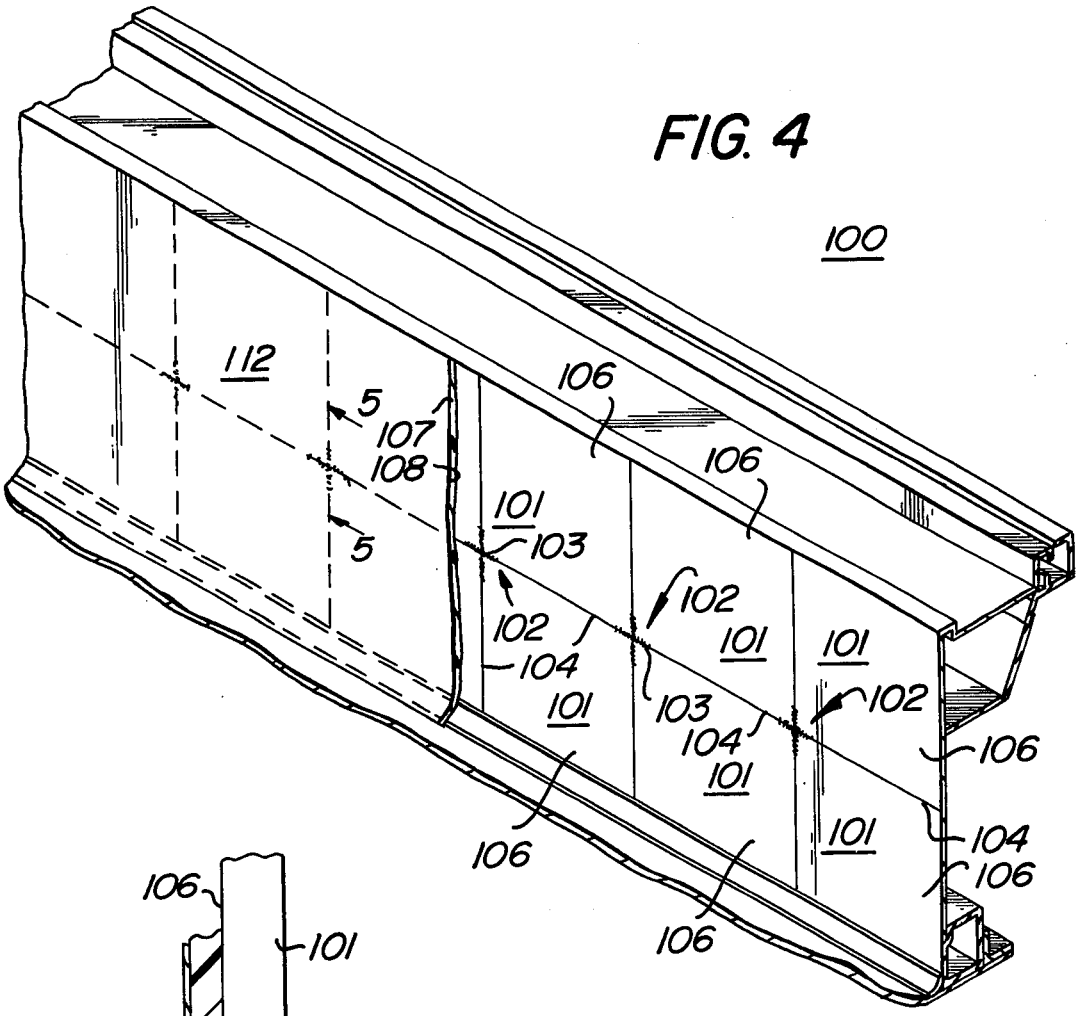
FIG. 4 is a view similar to FIG. 1 showing another form of swimming pool constructed in accordance with the method of my invention.

It should, of course, be understood that the description and drawings herein are illustrative merely and that various modifications and changes can be made in the method disclosed without departing from the spirit of the invention.

DESCRIPTION OF THE PREFERRED METHOD OF THE INVENTION

Referring now more particularly to the drawings and FIGS. 1, 2, and 3, thereof, one form of in ground swimming pool is illustrated.

The first step in constructing the pool 10 is to excavate the soil to obtain a hole in the ground the approximate size and shape of the finished pool.

If it is desired to treat or stabilize the exposed soil any suitable material may be used that will react with the soil and form a crust as well as fill in minor irregularities.

A U-shaped channel 11 is laid around the perimeter of the hole at a point where the wall 12 of the hole starts to curve and the channel 11 may be retained in position by stakes 13 driven into the soil.

A plurality of interlocking boards 15 of rectangular shape are placed in the channel 11 and extend vertically upwardly. The boards 15 are flat on both the front wall 16 facing the interior of the pool and the rear wall 17 facing the soil and each has an interlocking portion 18 along each side for engagement with like portions on adjacent boards. Any suitable interlocked boards can be employed assembled and supported in any desired manner.

The boards 15 are preferably of aluminum but other suitable rigid materials compatible with the plastic to be applied thereagainst as described below, may be used if desired.

If desired, prior to further operations the cavity between the board wall 20 and wall 12 may be filled with any suitable material 21, lightweight concrete being particularly suitable.

The interior pool wall is then formed by spraying plastic material in liquid form against the front wall 16 of boards 15 the length of the boards. The plastic material adheres to the boards 15, foams and forms a hard smooth layer on the boards 15. The plastic material in liquid form is then applied in successive coats against the bottom one third of the boards 15 and the soil below the boards which plastic material foams and in a short time forms a hard unitary mass 25.

The plastic material 25, which is preferably polyurethane but can be any suitable self foamable plastic material, may be applied in the preferred form in a single coat application or in multiple coats which coats intermingle to form a homogenous layer.

One preferred method of wall construction is to apply over the board wall 20 a one quarter inch thick layer of foamable polyurethane plastic having a density in the range of from 2 to 10 pounds per square foot for the full height of board 15. Foamable polyurethane plastic of the same density is applied over the layer on the board 15 beginning at a distance of approximately one third the height of the board 15 as measured from the channel 11 and over the soil with successive coat applications to provide an increasing thickness of foam of approximately two inches. The foamable plastic foams, hardens and forms a homogenous layer with a hard outer skin 26.

The determination as to the foam density and thickness in the density range of 2 to 10 pounds per cubic foot is dependent on climate and soil conditions, with foam of higher density preferred where the soil is soft and foam of lower density where the soil is hard.

As the liquid plastic foams and hardens it adheres to the front board wall 20 and with the boards 15 ties the structure into a unitary mass which is very strong and resistant to damage.

The exposed outer surface of the hard outer skin 26 of foamed plastic is preferably coated with an ultraviolet protective material 27 such as vinyl, chlorinated rubber or asphaltum to provide protection from sun light and from moisture.

When aluminum is used for constructing the boards 15 the plastic adheres very tightly to the boards due to the heat conductivity of the aluminum.

If desired, a coping 30 may be provided, of the preformed type, or which may be formed in place. The coping 30 can be of extruded polyethlene plastic, or of lightweight concrete of well known type or any other suitable material compatible with the plastic material forming the pool shell.

Figure 5:
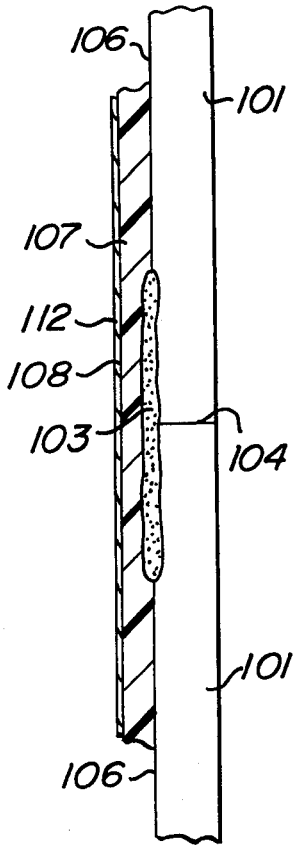
FIG. 5 is a fragmentary sectional view, enlarged, taken approximately on the line 5—5 of FIG. 4.

Referring now to FIGS. 4 and 5, another type of swimming pool 100 is therein illustrated of the all metal type. Such all metal pools are popular in many areas and while they may be utilized above or below suffer from heat retention problems due to the high heat conductivity of the metal walls. The pool 100 consists of a multiplicity of rectangular plates 101 preferably of aluminum and may be of a thickness of one half inch. Four plates 101 are shown at an intersection 102 where the adjoining plates 101 have welds 103 joining them for a short distance from the intersection 102 along their abutting edges and between which cracks 104 exist. Plastic material in liquid form, to provide a stabilized foam layer is sprayed against the surface 106 of plates 101, which material adheres thereto, foams and in a short time forms a hard resilient foam mass including a stabilized foam layer 107 and a hardened outer skin 108 facing the interior of the pool 100. The layer of foam 107 can be of any suitable self-foamable plastic with polyurethane plastic being a preferred material.

Polyurethane foam is particularly suitable for use with aluminum due to the high heat conductivity of the aluminum which conductivity during foam curing results in a very strong adherence of the foam layer 107 to the plate 100 surface 110. Aluminum is a material which is not noted for paint adherence but the foam layer 107 presents a surface skin 108 which can be coated with an ultraviolet protective material 112 such as vinyl, chlorinated rubber or asphaltum, all of which provide suitable protection from the sun's rays and from moisture.

The foam wall layers 25 and 107 act as insulation reducing heat transmission through the pool walls to or from the ground. The temperature of the pool water is therefore not appreciably effected by sudden changes in the ground temperature, is maintained at a more even level and is less subject to fluctuation than in previous structures.

The foam layers 25 and 107 are considerably more resilient than the metal surfaces which they cover with the result that bather contact with the foam is much less likely to result in injury to a swimmer or bather than contact with the aluminum pool wall surface.

It will thus be seen that the method has been described with which the objects of the invention have been achieved.

I claim:

1. The method of constructing a swimming pool which comprises assembling a static structure comprising a plurality of metallic components having flat vertically disposed interior faces providing an interior exposed wall surface around the perimeter of the pool with a potentiality for water leakage therethrough, spraying a foamable synthetic plastic material in liquid form towards said wall surface for adherence thereto of at least on layer of stabilized foam with a hardened exterior skin, and applying an ultraviolet protective material to the exterior skin.

2. The method of constructing a swimming pool as defined in claim 1 wherein said plastic material is polyurethane.

3. The method of constructing a swimming pool as defined in claim 1 wherein said metallic components comprise a plurality of boards engaged along their meeting edges.

4. The method of constructing a swimming pool as defined in claim 3 wherein coping is placed on the top of the boards prior to spraying of said plastic material.

5. The method of constructing a swimming pool as defined in claim 1 in which said metallic components comprise a plurality of aluminum plates with the edges in meeting relation, and said plates are welded together at their meeting corners.

* * * * *

UNITED STATES PATENT OFFICE

CERTIFICATE OF CORRECTION

Patent No. 4,027,442 Dated June 7, 1977

Inventor(s) Herman Silverman

It is certified that error appears in the above-identified patent and that said Letters Patent are hereby corrected as shown below:

Column 4,

Line 40, between "below" and "suffer", insert - ground - .

Claim 1, Column 6,

Line 3, change "on" to - one - .

Signed and Sealed this

*twenty-third* Day of *August 1977*

[SEAL]

*Attest:*

RUTH C. MASON
*Attesting Officer*

C. MARSHALL DANN
*Commissioner of Patents and Trademarks*